US006145436A

United States Patent [19]

Natalizia et al.

[11] Patent Number: 6,145,436

[45] Date of Patent: Nov. 14, 2000

[54] LABEL TRANSPORT SHUTTLE FOR A PRINTING DEVICE

[75] Inventors: Michael J. Natalizia; Zachery J. Schartner, both of Narragansett, R.I.

[73] Assignee: Astro-Med, Inc., West Warwick, R.I.

[21] Appl. No.: 09/300,667

[22] Filed: Apr. 27, 1999

[51] Int. Cl.[7] ..... B41F 1/08

[52] U.S. Cl. ..... 101/288; 156/384

[58] Field of Search ..... 101/228, 288, 101/92; 156/384, 387, 577, DIG. 49

[56] References Cited

U.S. PATENT DOCUMENTS

| | | | |
|---|---|---|---|
| 4,111,121 | 9/1978 | Borum | 101/228 |
| 4,712,114 | 12/1987 | Kikuchi | 101/288 |
| 4,784,714 | 11/1988 | Shibata | 156/354 |
| 4,886,566 | 12/1989 | Peyre | 156/361 |
| 5,033,881 | 7/1991 | Koike | 101/288 |
| 5,188,029 | 2/1993 | Sugimoto et al. | 101/288 |
| 5,437,228 | 8/1995 | Uland | 101/288 |
| 5,674,345 | 10/1997 | Nash | 156/384 |
| 5,675,369 | 10/1997 | Gaskill | 347/171 |

*Primary Examiner*—Ren Yan
*Attorney, Agent, or Firm*—Salter & Michaelson

[57] ABSTRACT

A transport apparatus and method for transporting labels along a printing path of a printing device is disclosed. The transport apparatus includes a label transfer station including a first peeling device for deflecting the web supplied by the payoff roller to a take-up roller, the deflection of the web being at such an angle that a label mounted on the web is peeled from the web as the web passes over the first peeling device, a discrete carrier for receiving the peeled label from the web and transporting the label along the printing path and through the printing assembly and a second peeling device for deflecting the discrete carrier, the deflection of the discrete carrier being at such an angle that the label mounted on the discrete carrier is peeled from the discrete carrier as it passes over the second peeling device.

8 Claims, 4 Drawing Sheets

LABEL TRANSPORT SHUTTLE FOR A PRINTING DEVICE

BACKGROUND OF THE INVENTION

1. Field of the Invention

The present invention generally relates to printing devices and, more particularly, to a printing device for printing adhesive labels and the like having a continuous belt system for transporting the labels through printing assemblies of the printing device.

2. Discussion of the Related Art

In typical label printing devices, labels having a pressure-sensitive adhesive are serially mounted on a roll which typically consists of a media web of paper or plastic film. The roll is mounted on a payoff roller of the printing device and the web including the labels mounted thereon is threaded through the printing assemblies of the printing device to enable the printing assemblies to print on each label as it passes therethrough. The web is pulled through the printing assemblies by a series of pinch rollers located along the feed path. After passing through the printing assemblies and pinch rollers, the web is fed out of the printing device and either re-rolled onto a take-up roller or the label is manually peeled of the web as it exits the printing device for immediate application to a product which the label is to identify.

However, it has been found that the quality of the printing performed by the above-described printing apparatus can be adversely affected as the web is pulled through the printing device. Since the pinch rollers must contact the labels immediately after they are printed on, there is a potential for the rollers smudging or otherwise affecting the print quality. Moreover, since the labels are fed through the printing assemblies on the media web, any inconsistencies in the web or in the speed at which the web is pulled can cause problems in the printing process. For example, any slack in the web will adversely affect the contact between the printing head and the label and any slippage between the pinch rollers and the media web will cause smudging in the printing process. Furthermore, since the labels are typically mounted on a wax paper-type printing media, any wrinkles or other inconsistencies in the media web can adversely affect print quality and can also cause the web to break as it is pulled through the printing apparatuses, thus causing downtime of the printing device and requiring that the web be rethreaded through the printing apparatuses.

Another disadvantage of the prior art system is the inability to print individual labels on demand or to vary the speed or frequency at which labels are printed. Since the labels are pulled through the printing apparatuses while being mounted on the media web, the labels can only be printed at a single speed which is determined by the spacing of the labels on the media web as it is passed through the printing assemblies. Furthermore, if it is desired to print only one label, the label must be fed through each printing assembly and peeled off of the media web, which them must be pulled back through each printing assembly in order to line up the next label to be printed on with the first printing assembly. This process is very time consuming and complicated.

What is needed is a printing device which includes a discrete carrier belt which serially receives the labels as they are peeled from the media web and transports the labels through the printing assemblies without the use of pinch rollers which can adversely affect the print quality of the printing device. The carrier belt will provide a more durable and consistent platform on which the labels are transported through the printing assemblies. The device would also be capable of printing labels at varying speeds and frequencies and printing one label at a time without the need for backing the media web through the printing assemblies.

SUMMARY OF THE INVENTION

The present invention provides a transfer mechanism which transfers labels from a media web onto a discrete belt for passage through the printing device. The transfer mechanism eliminates the possibility of printing problems associated with the media web and eliminates the pinch roller system which can adversely affect the print quality of the resulting labels.

The transfer mechanism of the present invention is capable of operating in three different modes. In a "demand" mode, it can print only one label at a time, in a "semi-continuous" mode, it can print a set of multiple labels randomly spaced on the transfer mechanism and, in a "continuous" mode, it can print multiple tickets which are evenly spaced on the transfer mechanism.

According to a first embodiment, a transport apparatus for transporting labels along a printing path of a printing device is disclosed. The transport apparatus comprises a label transfer station including a first peeling device for deflecting the web supplied by the payoff roller to a take-up roller, the deflection of the web being at such an angle that a label mounted on the web is peeled from the web as the web passes over the first peeling device, a discrete carrier for receiving the peeled label from the web and transporting the label along the printing path and through the printing assembly and a second peeling device for deflecting the discrete carrier, the deflection of the discrete carrier being at such an angle that the label mounted on the discrete carrier is peeled from the discrete carrier as it passes over the second peeling device. The transport apparatus comprises a first air blowing device downstream of the first peeling device for directing a S stream of air at an underside of the label as it is peeled from the web, the first air blowing device further facilitating the peeling of the label from the web and a second air blowing device downstream of the first air blowing device for directing a stream of air at a top side of the label as it is peeled from the web, the second air blowing device further facilitating the receipt of the label by the discrete carrier. The discrete carrier comprises a strip of finite length, the strip being unwound from a second payoff roller, receiving the label from the web at the transfer station, transporting the label along the printing path and through the printing assembly and across the second peeling device and then being rewound onto a take-up roller after the label is peeled from the carrier by the second peeling device.

According to a second embodiment, the discrete carrier comprises a continuous belt, the continuous belt receiving the label from the web at the transfer station, transporting the label along the printing path and through the printing assembly and across the second peeling device and then returning to the transfer station to receive another label from the web after the label is peeled from continuous belt the by the second peeling device.

According to a third embodiment, a method for transporting a label through a printing device is disclosed, comprising the steps of deflecting the web supplied by the payoff roller to a take-up roller with a first peeling device, the deflection of the web being at such an angle that a label mounted on the web is peeled from the web as the web passes over the first peeling device, receiving the peeled label on a discrete carrier and transporting the label along the printing path and through the printing assembly and deflecting the discrete carrier with a second peeling device, the deflection of the discrete carrier being at such an angle that the label mounted on the discrete carrier is peeled from the discrete carrier as it passes over the second peeling device.

Other features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION

Figure 1:
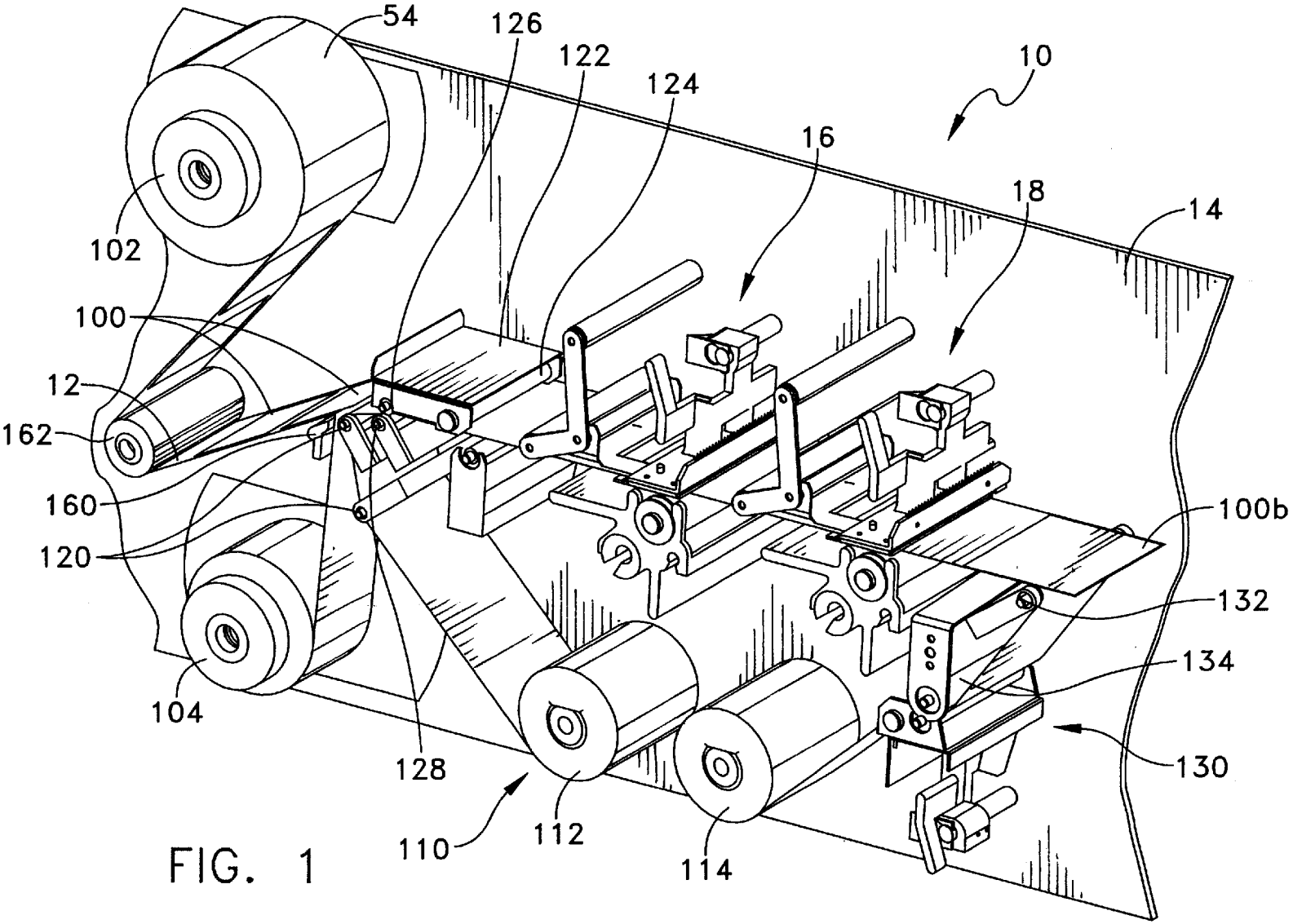
FIG. 1 is a perspective view of the printing device of a first embodiment of the label transport shuttle of the present invention.
Figure 2:
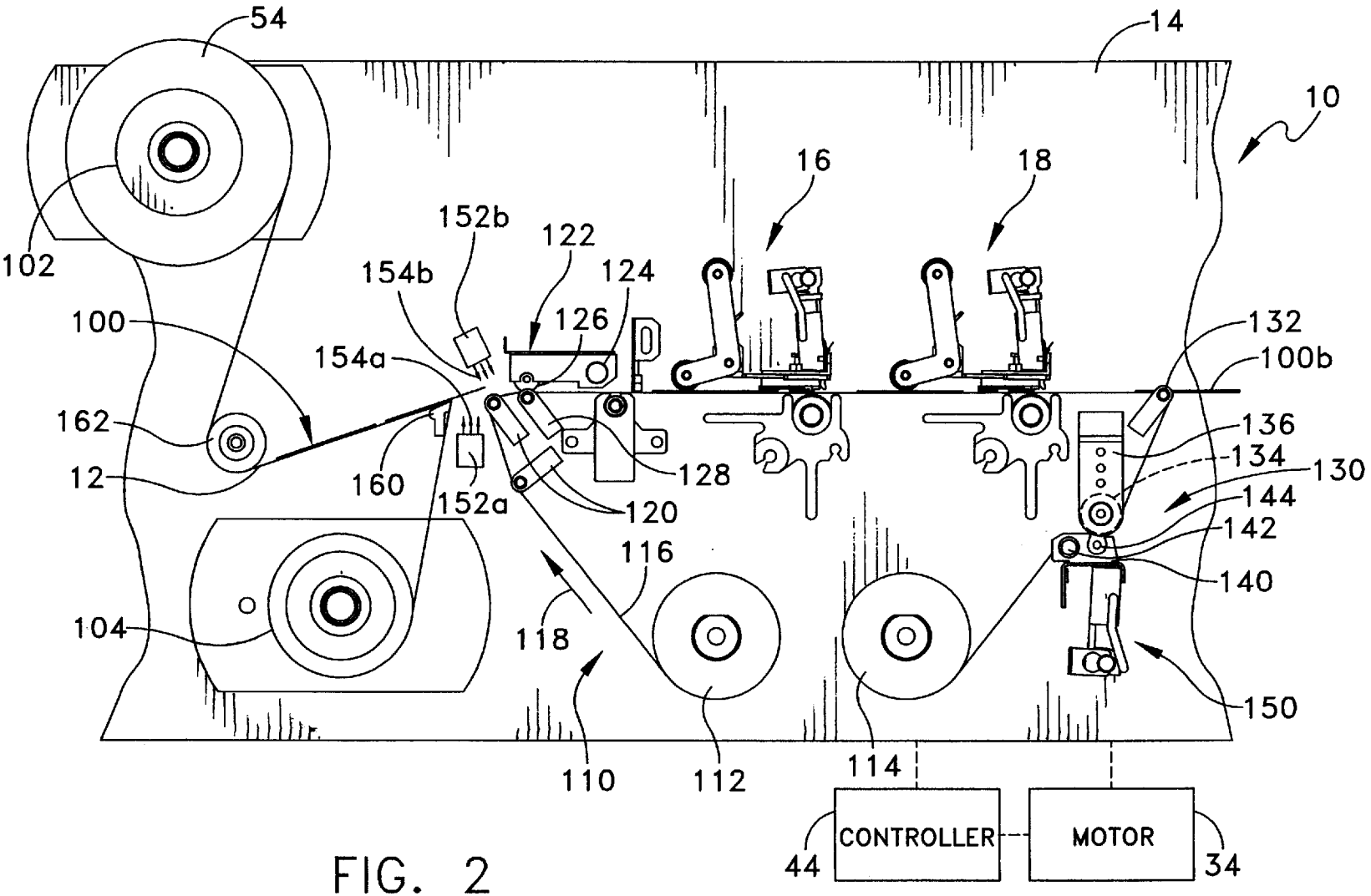
FIG. 2 is a front view of the printing apparatus of the first embodiment of the label transport shuttle of the present invention.

Referring now to the figures, the label transport of the present invention will be described. A first embodiment of the label transport shuttle is shown in FIGS. 1 and 2. A printing device, generally indicated at 10, is operable for printing images on adhesive labels 100 which are serially fed through the printing assemblies of the printing device 10. The printing device 10 includes a back plate generally indicated at 14, which is partially shown for simplicity, on which the components of the printing device 10 are mounted. Adhesive labels 100 typically comprise plastic or paper sheets having a pressure sensitive adhesive on a back side thereof which are mounted on a media web 12. Media web 12 typically comprises a continuous strip of a paper or non-woven substrate having a width of approximately 1 to 5 inches. The web 12 is provided in a continuous roll 54 which is rotatably mounted on a payoff roller 102 which is mounted to back plate 14. After a label 100 is removed from the web 12, as will be described below, the web 12 is rewound onto a take-up roller 104, also rotatably mounted to back plate 14.

The printing device 10 also includes first and second printing assemblies generally indicated at 16 and 18 for printing first and second images on the labels 100, printing film drive assemblies (not shown) for supplying printing film to each printing station 16 and 18. The printing assemblies 16 and 18 are constructed and operate in a similar manner to the printing assemblies described in U.S. Pat. No. 5,675,369, which is commonly owned by the assignee of this application, and which is herein incorporated by reference in its entirety. Accordingly, a description of the construction and operation of the printing assemblies 16 and 18 will not be included herein.

The label transport shuttle, generally indicated at 110, will now be described. The label transport shuttle 110 includes a payoff roller 112 and a take-up roller 114. Payoff roller 112 has mounted thereon a carrier strip 116 for transporting labels through the printing assemblies 16 and 18. The carrier strip 116 is preferably made from any durable, flexible, relatively non-stretchable material, such as paper, plastic or rubber. The material used, however, must have surface properties which allow an adhesive label to be easily adhered to and removed from the carrier strip. The carrier strip is fed into the printing assemblies in the direction shown by arrow 118. Guide rolls 120 take up any slack in the carrier strip 116 and steer the carrier strip 116 toward the printing assemblies 16 and 18. A pressure roller assembly 122 is pivotally mounted to the back plate 14 on a pivot pin 124 and includes a rubberized pressure roller 126. Pressure roller assembly 122 is biased to urge pressure roller 126 into a roller 128 to press a label 100 onto the carrier strip 116, as will be described in greater detail below. After passing through printing assemblies 16 and 18, the carrier strip 116 is steered toward a drive assembly, generally indicated at 130, by a peeling roller 132.

The drive assembly 130 includes a drive roller 134 having a rubberized outer shell and a mounting bracket 136 for mounting the drive roller 134 to the back plate 14. A pressure roller assembly, generally indicated at 140, is pivotally mounted to the back plate 14 on a pivot pin 142 and includes a rubberized pressure roller 144. A toggle element, generally indicated at 150, includes a spring mechanism (not shown) for biasing the pressure roller 144 of the pressure roller assembly 140 against the drive roller 134. The carrier strip 116, which is disposed between the drive roller 134 and the pressure roller 144, is pulled through the printing assemblies 16 and 18 by the operation of the drive roller assembly. After the carrier strip passes through drive assembly 130, it is rewound onto take-up roller 114.

The label transport shuttle 110 also includes a pair of air knives 152*a* and 152*b* and a peel edge 160, all of which are mounted to back plate 14, for assisting in the transfer of the labels 100 from the web 12 to the carrier strip 116, as will be discussed in greater detail below. A stepped motor 34 and a controller 44, both shown schematically in FIG. 2, control the operation of the printing device 10. The stepped motor 134 is drivingly coupled to the drive roller 134 in a conventional manner. The controller 44 is operable in a conventional manner and includes a programmable microprocessor which can be programmed for control of the stepping motor 34, printing apparatuses 16 and 18, drive assembly 130 and take-up rollers 104 and 114. More specifically, the controller 44 is programmed so that it is responsive to a predetermined number of stepped rotational increments of the stepping motor 34 for coordinating the energization of the print heads of the printing assemblies 16 and 18.

The take-up rollers 104 and 114 are rotatably mounted to back plate 14 and they are drivingly coupled to drive motors (not shown) through conventional slip clutch mechanisms (not shown). During operation of apparatus 10, the drive motors are operated to rotate the take-up rollers 104 and 114 in order to advance the web 12 and carrier strip 116, respectively. However, the slip clutches are designed so that they increasingly slip as the wound diameters of the take-up rollers 104 and 114 are increased in order to maintain substantially constant web and carrier strip speeds throughout the printing processes.

The operation of the label transport shuttle 110 will now be described. As the web 12 with the labels 100 mounted thereon is pulled from the payoff roller 102, it is directed around a guide roller 162 toward the printing assemblies 16 and 18. The web 12 is then pulled toward take-up roller 104 as it passes over the peel edge 160. The web 12 is deflected by the peel edge 160 at an angle, preferably greater than 90°, such that a label 100*a* is peeled from the web 12 and continues toward the printing assemblies 16 and 18. In this connection, the labels 100 must be made of a material and thickness which provides a stiffness to the label which enables the label to peel from the web 12 as the web is deflected by the peel edge 160. Furthermore, the label must be constructed to have a adhesive layer which is of a sufficient adhesion to allow the label to be peeled from the web 12 in such a manner. The peeling of the label 100*a* is assisted by an air knife 152*a* which directs a stream of air at the underside of the label 100*a* as shown by the arrows 154*a*. The air stream 154*a* helps to push the label 100*a* away from the web 12. The label 100*a* then encounters air knife 152*b*, which directs a stream of air at the top of the label 100*a* as shown by the arrows 154*b*. The air stream 154*b* pushes the label 100*a* onto the carrier strip 116 as it is pulled through the printing assemblies by the drive roller assembly 130, as described above.

As the label 100*a* is pushed toward the carrier strip 116 by the air knife 152*b*, it encounters pressure roller 126 of pressure roller assembly 122. Pressure roller 126 presses label 100*a* onto the carrier strip 116, causing the label 100*a* to adhere to the carrier strip 116. The distance between the peel edge 160 and the pressure roller 126 is such that the front edge of the label 100*a* is pressed onto the carrier strip 116 by the pressure roller 126 before the rear edge of the label 100*a* is peeled from the web 12. This ensures that the label 100*a* will be properly oriented on the carrier strip 116 as it is printed on. Once the entire label is pressed into adherence with the carrier strip 116 by pressure roller assembly 122, it passes through the printing assemblies 16 and 18 for printing.

After exiting printing assembly 18, the web is deflected around peeling roller 132 at such an angle that the label 100*b*, is peeled from the carrier strip 116 in a similar manner as the label 100*a* is peeled from the web 12. While not shown in the figures, another air knife may be used to direct an air stream at the underside of the label 100*b* to further assist in the peeling of the label 100*b* from the carrier strip 116. The label 100*b* may then be manually handled for application on a product or it may be fed into a machine which applies the label to a product. The carrier strip 116 is pulled through drive assembly 130 and rewound onto take-up roll 114.

This operation continues for the printing of all labels 100 on the continuous roll 54. When the carrier strip 116 is completely wound off of payoff roller 112 onto take-up roller 114, a new carrier strip is loaded onto payoff roller 112, threaded through the printing device 10 and the drive assembly 130 and onto take-up roller 114.

A second embodiment of the invention will now be described with reference to FIGS. 3 and 4. The embodiment shown in FIG. 3 and 4 includes a label transport shuttle, generally indicated at 210, for transporting labels through the printing assemblies 16 and 18 of the printing device 10. Components which are identical to those shown in the embodiment of FIGS. 1 and 2 are indicated with identical reference numerals.

Figure 3:
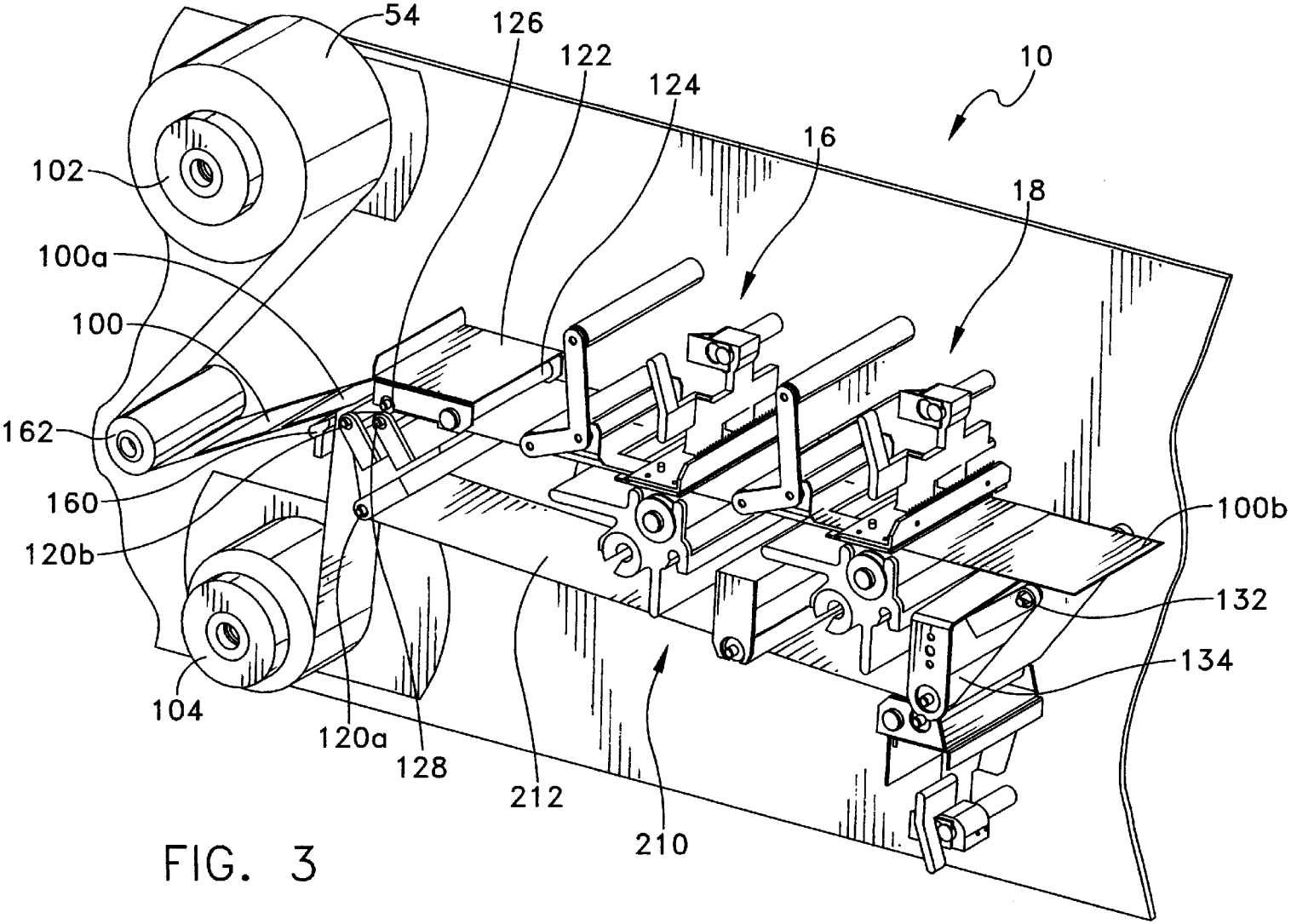
FIG. 3 is a perspective view of the printing device of a second embodiment of the label transport shuttle of the present invention.
Figure 4:
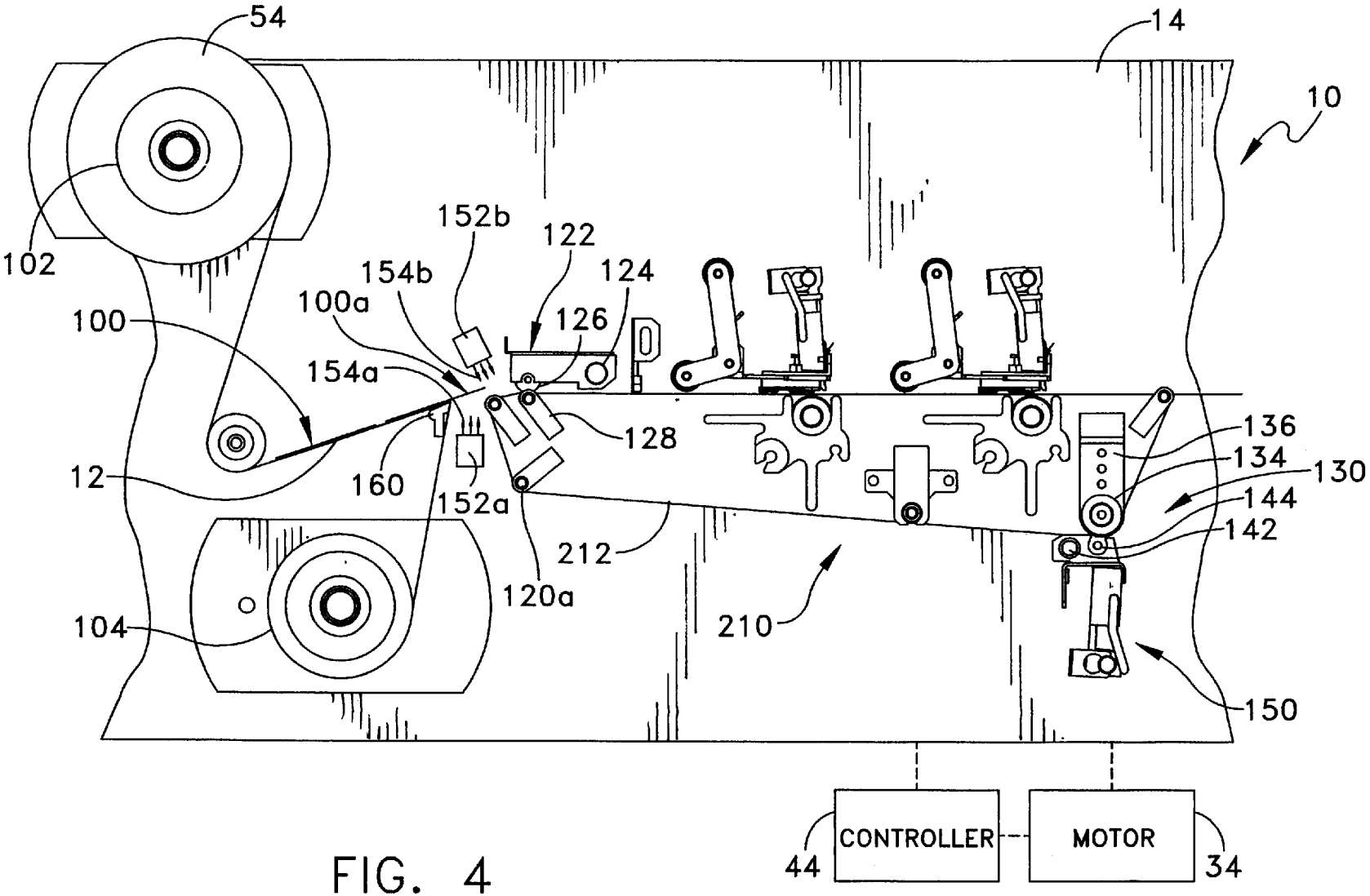
FIG. 4 is a front view of the printing apparatus of the second embodiment of the label transport shuttle of the present invention.

As shown is FIGS. 3 and 4, the label transport shuttle 210 includes a continuous carrier belt 212 which is driven by drive assembly 130. Carrier belt 212 may be made from plastic, rubber, or any other suitable material which provides sufficient durability and flexibility. Rather than feeding the carrier strip 116 from payoff roller 112 onto take-up roller 114, the carrier belt 212 exits the drive assembly 130 and continues to roller 120*a*. The remaining path taken by the carrier belt 212 is identical to the path taken by carrier strip 116 of the embodiment of FIGS. 1 and 2. Likewise, the transfer of labels onto and off of the carrier belt 212 is identical to the transfer of labels described with reference to the embodiment of FIGS. 1 and 2.

This embodiment allows the printing device to be operated continuously, while only ceasing the printing operation to replace the continuous roll 54 when it is completely run out. This embodiment reduces downtime of the printing device, since the carrier belt only needs to be replaced at regular maintenance intervals, which can be much less frequent than the replacement interval associated with the embodiment of FIGS. 1 and 2.

It can be therefore seen that the present invention provides a novel and effective apparatus for transporting labels through a printing device. The apparatus provides a discrete carrier belt which serially receives the labels as they are peeled from the media web and transports the labels through the printing assemblies without the use of pinch rollers which can adversely affect the print quality of the printing device. The carrier belt also provides a more durable and consistent platform on which the labels are transported through the printing assemblies. The transfer mechanism of the present invention is capable of operating in three different modes. In a "demand" mode, it can print only one label at a time, in a "semi-continuous" mode, it can print a set of multiple labels randomly spaced on the belt and, in a "continuous" mode, it can print multiple tickets which are evenly spaced on the belt.

While there is shown and described herein certain specific structure embodying the invention, it will be manifest to those skilled in the art that various modifications and rearrangements of the parts may be made without departing from the spirit and scope of the underlying inventive concept. For example, while, in the preferred embodiment, the apparatus 10 includes two printing assemblies, it can include any number of printing assemblies. Furthermore, any reasonable width of the media web, belt or printing film may be used. Accordingly, the inventive concept is not limited to the particular forms herein shown and described except insofar as indicated by the scope of the appended claims.

What is claimed is:

1. A transport apparatus for transporting labels along a printing path of a printing device, the printing device comprising a payoff roller for supplying a continuous serial supply of labels on a web and a printing assembly for applying images to the labels, the transport apparatus comprising:

a label transfer station including a first peeling device for deflecting the web supplied by the payoff roller to a take-up roller, the deflection of the web being at such an angle that a label mounted on the web is peeled from the web as the web passes over the first peeling device;

a discrete carrier for receiving a label as it is peeled from the web and transporting the label along the printing path and through the printing assembly; and a second peeling device for deflecting the discrete carrier, the deflection of the discrete carrier being at such an angle that the label mounted on the discrete carrier is peeled from the discrete carrier as it passes over the second peeling device.

2. The transport apparatus of claim 1, further comprising a first air blowing device downstream of said first peeling device for directing a stream of air at an underside of the label as it is peeled from the web, the first air blowing device further facilitating the peeling of the label from the web.

3. The transport apparatus of claim 2, further comprising a second air blowing device downstream of said first air blowing device for directing a stream of air at a top side of the label as it is peeled from the web, the second air blowing device further facilitating the receipt of the label by the discrete carrier.

4. The transport apparatus of claim 1, further comprising a drive mechanism for driving the discrete carrier along the printing path and through the printing assembly.

5. The transport apparatus of claim 1, wherein said discrete carrier comprises a strip of finite length, said strip being unwound from a second payoff roller, receiving said label from said web at said transfer station, transporting the label along the printing path and through the printing assembly and across the second peeling device and then being rewound onto a take-up roller after the label is peeled from the carrier by the second peeling device.

6. The transport apparatus of claim 1, wherein said discrete carrier comprises a continuous belt, said continuous belt being rotatably mounted between said transfer station and said second peeling device for receiving said label from said web at said transfer station, transporting the label along the printing path and through the printing assembly and across the second peeling device.

7. The transport apparatus of claim 6, wherein said continuous belt is operative to continuously receive labels at said transfer station and deposit labels from said second peeling device, said continuous belt traveling in a loop between said transfer station and said second peeling device.

8. A method for transporting a label along a printing path and through a printing device, the printing device comprising a payoff roller for supplying a continuous serial supply of labels on a web and a printing assembly for applying images to the labels, the method comprising the steps of:

deflecting the web supplied by the payoff roller to a take-up roller with a first peeling device, the deflection of the web being at such an angle that a label mounted on the web is peeled from the web as the web passes over the first peeling device;

receiving the peeled label on a discrete carrier and transporting the label along the printing path and through the printing assembly; and deflecting the discrete carrier with a second peeling device, the deflection of the discrete carrier being at such an angle that the label mounted on the discrete carrier is peeled from the discrete carrier as it passes over the second peeling device.

* * * * *